US010635047B2

(12) United States Patent
Kamoshida et al.

(10) Patent No.: US 10,635,047 B2
(45) Date of Patent: Apr. 28, 2020

(54) CARTRIDGE AND IMAGE FORMING APPARATUS USING THE CARTRIDGE

(71) Applicant: CANON KABUSHIKI KAISHA, Tokyo (JP)

(72) Inventors: Shigemi Kamoshida, Yokohama (JP); Hiroyuki Munetsugu, Yokohama (JP); Shohei Katsuya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/278,881

(22) Filed: Feb. 19, 2019

(65) Prior Publication Data

US 2019/0258202 A1 Aug. 22, 2019

(30) Foreign Application Priority Data

Feb. 21, 2018 (JP) ..... 2018-028912

(51) Int. Cl.
*G03G 21/18* (2006.01)
*G03G 15/00* (2006.01)
*G03G 21/16* (2006.01)

(52) U.S. Cl.
CPC ..... *G03G 21/1853* (2013.01); *G03G 15/5008* (2013.01); *G03G 15/75* (2013.01); *G03G 15/757* (2013.01); *G03G 21/1647* (2013.01); *G03G 21/1671* (2013.01); *G03G 21/1676* (2013.01); *G03G 21/186* (2013.01); *G03G 21/1857* (2013.01)

(58) Field of Classification Search
CPC ..... G03G 21/1853; G03G 21/1671; G03G 21/1676; G03G 21/186; G03G 21/1647; G03G 21/1857; G03G 15/757; G03G 15/75; G03G 15/5008
See application file for complete search history.

(56) References Cited

U.S. PATENT DOCUMENTS 8,160,478 B2 4/2012 Munetsugu et al.
8,165,493 B2 4/2012 Chadani et al.
8,208,830 B2 6/2012 Uratani et al.
(Continued)

FOREIGN PATENT DOCUMENTS

JP 2007-193370 A 8/2007
JP 2009-025704 A 2/2009
(Continued)

*Primary Examiner* — Joseph S Wong
(74) *Attorney, Agent, or Firm* — Venable LLP

(57) ABSTRACT

A cartridge includes a photosensitive member assembly including a photosensitive member, a flange, and a coupling member. The cartridge includes a photosensitive member limiting portion configured to limit movement of the photosensitive member assembly to a first position in a second direction and to a second position in a first direction, and a coupling member limiting portion configured to limit movement of the coupling member to a third position in the second direction and to a fourth position in the first direction. The cartridge is constituted so that the photosensitive member assembly is in the second position and the coupling member is in the fourth position when the cartridge is mounted in the main assembly and an engaging portion of the cartridge member engages with a main assembly driving portion and the cartridge member is urged in the first direction by the main assembly driving portion.

10 Claims, 8 Drawing Sheets

(56) References Cited

U.S. PATENT DOCUMENTS

| | | | | |
|---|---|---|---|---|
| 8,478,166 | B2 * | 7/2013 | Hara | G03G 21/1853 399/167 |
| 8,559,849 | B2 | 10/2013 | Suzuki et al. | |
| 9,213,306 | B2 | 12/2015 | Morioka et al. | |
| 9,377,714 | B2 | 6/2016 | Nakazawa et al. | |
| 9,791,825 | B2 | 10/2017 | Kamoshida et al. | |
| 10,203,652 | B2 | 2/2019 | Kamoshida et al. | |
| 2002/0191981 | A1 * | 12/2002 | Miyabe | B29C 45/14467 399/90 |
| 2008/0152388 | A1 | 6/2008 | Ueno et al. | |
| 2009/0028597 | A1 | 1/2009 | Takigawa et al. | |
| 2012/0294649 | A1 * | 11/2012 | Kikuchi | G03G 15/757 399/117 |
| 2015/0220020 | A1 | 8/2015 | Hayashi et al. | |
| 2016/0246250 | A1 | 8/2016 | Kamoshida et al. | |
| 2017/0261926 | A1 | 9/2017 | Kashiide et al. | |
| 2017/0261927 | A1 | 9/2017 | Sato et al. | |
| 2017/0322512 | A1 | 11/2017 | Kamoshida et al. | |
| 2018/0224794 | A1 | 8/2018 | Kamoshida et al. | |
| 2018/0321637 | A1 | 11/2018 | Sato et al. | |
| 2018/0341214 | A1 | 11/2018 | Kamoshida et al. | |

FOREIGN PATENT DOCUMENTS

| | | | |
|---|---|---|---|
| JP | 2015-079243 | A | 4/2015 |
| JP | 2015-158692 | A | 9/2015 |

* cited by examiner (a)

(b)

(a)

(b)

(a)

(b)

(a)

(b)

CARTRIDGE AND IMAGE FORMING APPARATUS USING THE CARTRIDGE

FIELD OF THE INVENTION AND RELATED ART

The present invention relates to a cartridge and an image forming apparatus using the cartridge.

A constitution in which a coupling member provided on a coupling mountable in and dismountable from a main assembly of the image forming apparatus is engaged with an engaging portion on a main assembly side of the image forming apparatus and a rotational force from a driving source in the main assembly of the image forming apparatus is transmitted to the coupling member has been known. Further, Japanese Laid-Open Patent Application (JP-A) 2015-79243 discloses a coupling in which a coupling member for a drum unit including a photosensitive drum is constituted so as to be capable of being inclined with respect to a rotational axis direction of the photosensitive drum.

As in JP-A 2015-79243, in the case where the coupling member in the coupling is provided as a single component part relative to the drum unit in the coupling, the coupling member is disposed with a gap from the drum unit in consideration of a component (part) tolerance. For this reason, a position of the coupling member relative to the drum unit is not uniquely determined. Thus, even in the case where the coupling member is in a position remotest from a main assembly-side engaging portion with respect to the drum unit, in order to establish engagement of the coupling member with the main assembly-side engaging portion with reliability, there was need to increase in amount of engagement of the coupling member with the main assembly-side engaging portion with respect to a rotational axis direction (FIG. 30 of JP-A 2015-79243).

SUMMARY OF THE INVENTION

A principal object of the present invention is to provide a coupling capable of downsizing a coupling member as a rotational force transmitting means with respect to a rotational axis direction of a photosensitive drum and to provide an image forming apparatus using the coupling.

According to an aspect of the present invention, there is provided a cartridge mountable in and dismountable from a main assembly of an image forming apparatus, the cartridge comprising: a photosensitive member assembly including, a photosensitive member including a first end portion and a second end portion opposite from the first end portion with respect to a rotational axis direction thereof, a flange fixed at the first end portion of the photosensitive member so as to rotate together with the photosensitive member, and a coupling member configured to receive, from the main assembly, a driving force for rotating the photosensitive member, the coupling member including a connecting portion configured to connect with the flange and an engaging portion configured to engage with a main assembly driving portion of the main assembly; a photosensitive member limiting portion configured to limit movement of the photosensitive member assembly in the rotational axis direction including a first direction from the first end portion toward the second end portion and a second direction from the second end portion toward the first end portion, wherein the photosensitive member limiting portion limits the movement of the photosensitive member assembly to the first position in the second direction and limits the movement of the photosensitive member assembly to the second position in the first direction; and a coupling member limiting portion configured to limit movement of the coupling member in the rotational axis direction to a third position in the second direction and to a fourth position in the first direction, wherein the cartridge is constituted so that the photosensitive member assembly is in the second position and the coupling member is in the fourth position when the cartridge is mounted in the main assembly and the engaging portion of the cartridge member engages with the main assembly driving portion and the cartridge member is urged in the first direction by the main assembly driving portion.

Further features of the present invention will become apparent from the following description of exemplary embodiments with reference to the attached drawings.

BRIEF DESCRIPTION OF THE DRAWINGS

Parts (a) and (b) of FIG. 1 are schematic views for illustrating a state when a rotational force is transmitted from a main assembly-side engaging portion 14 to a coupling member 86 in a coupling.

Figure 4:
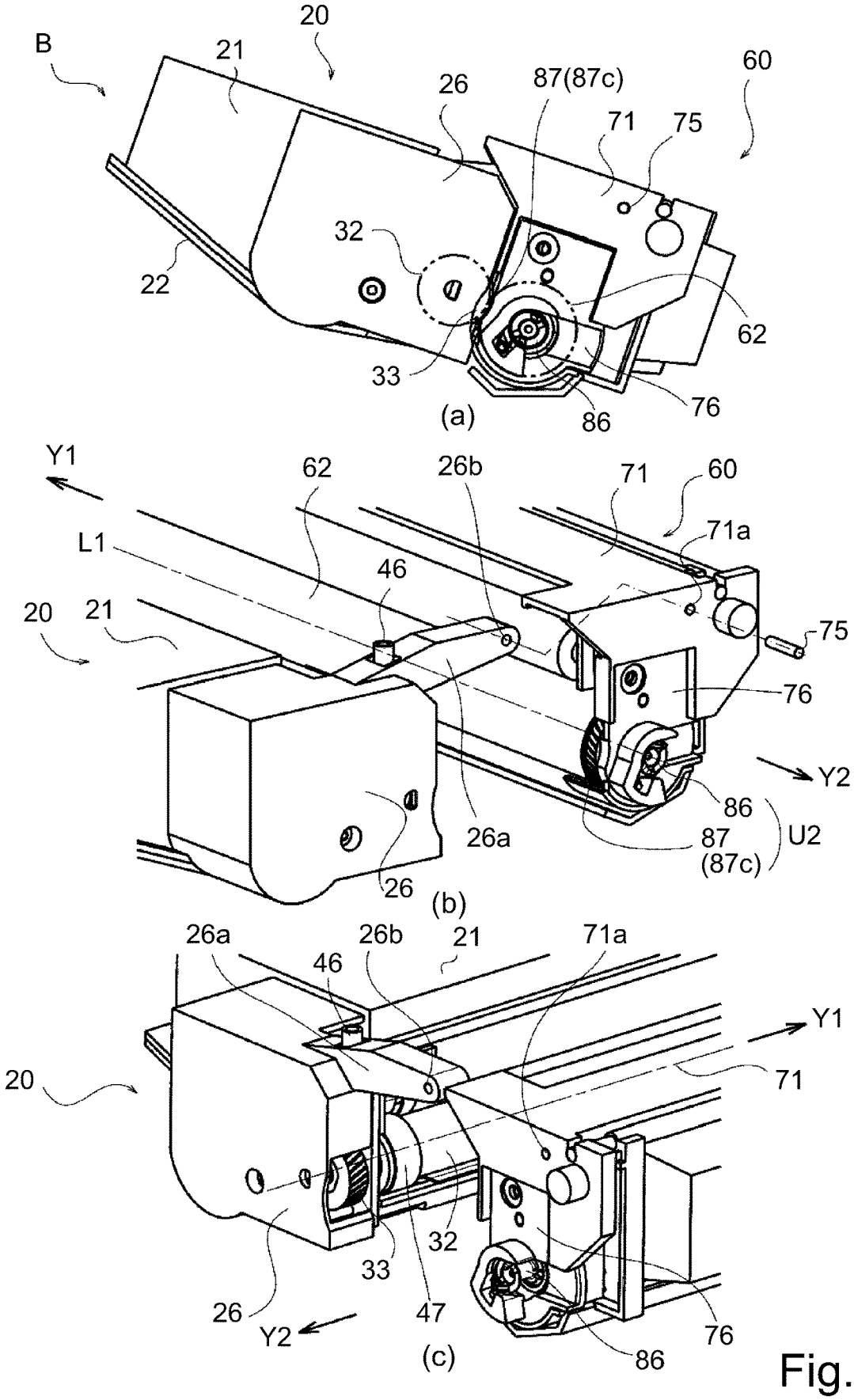

Parts (a), (b) and (c) of FIG. 4 are illustrations of the coupling B according to the embodiment of the present invention.

Figure 5:
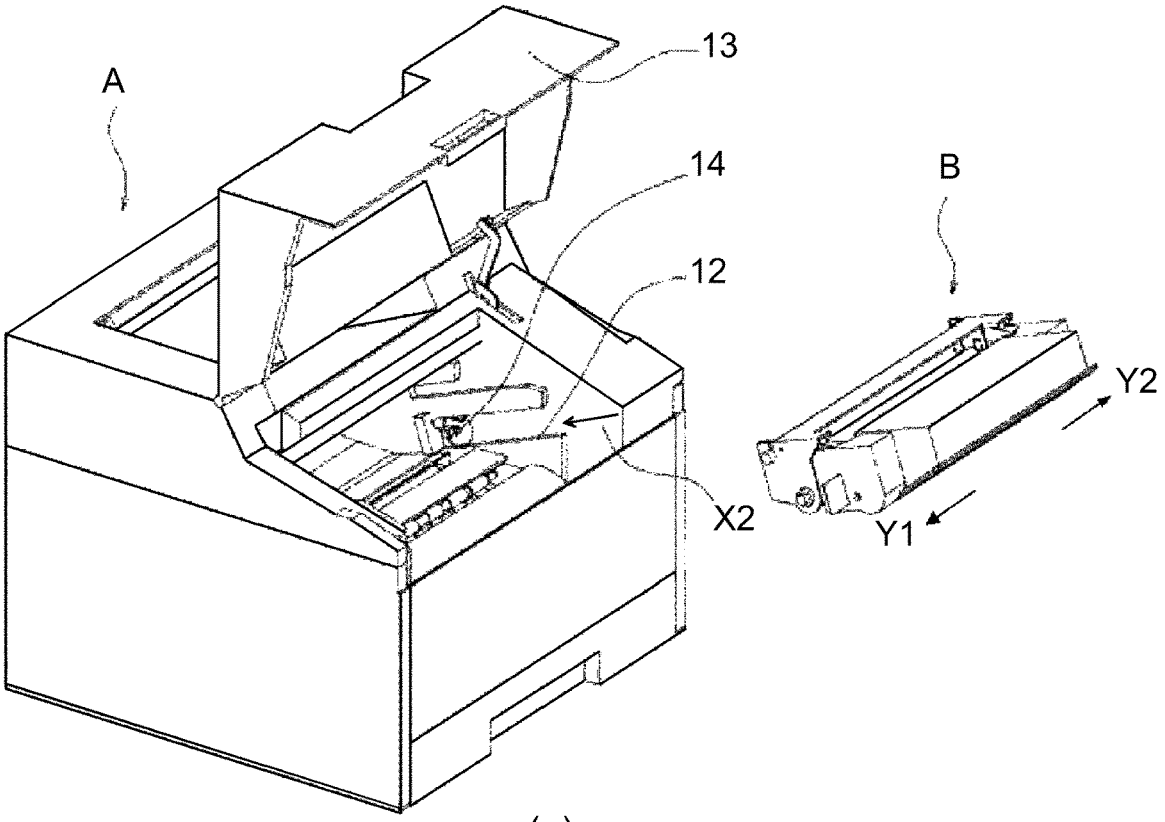
Figure 5:
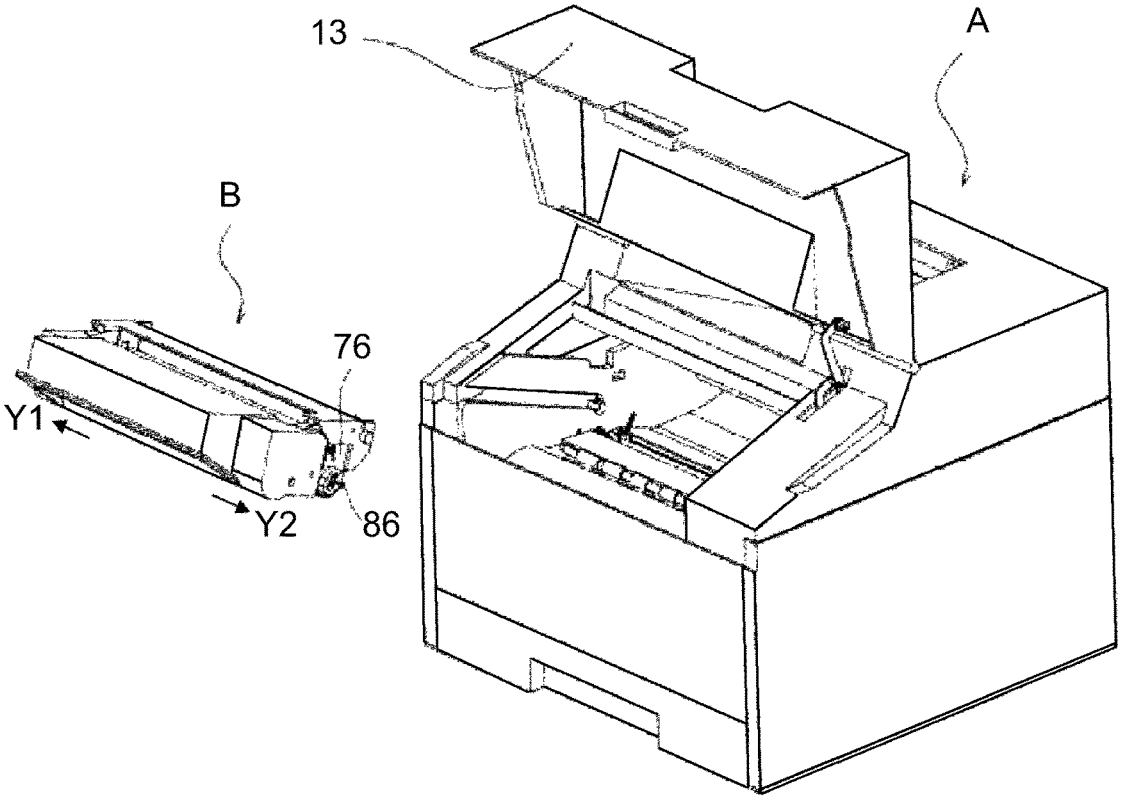

Parts (a) and (b) of FIG. 5 are illustrations of an operation of mounting the coupling B into the apparatus main assembly A.

Figure 6:
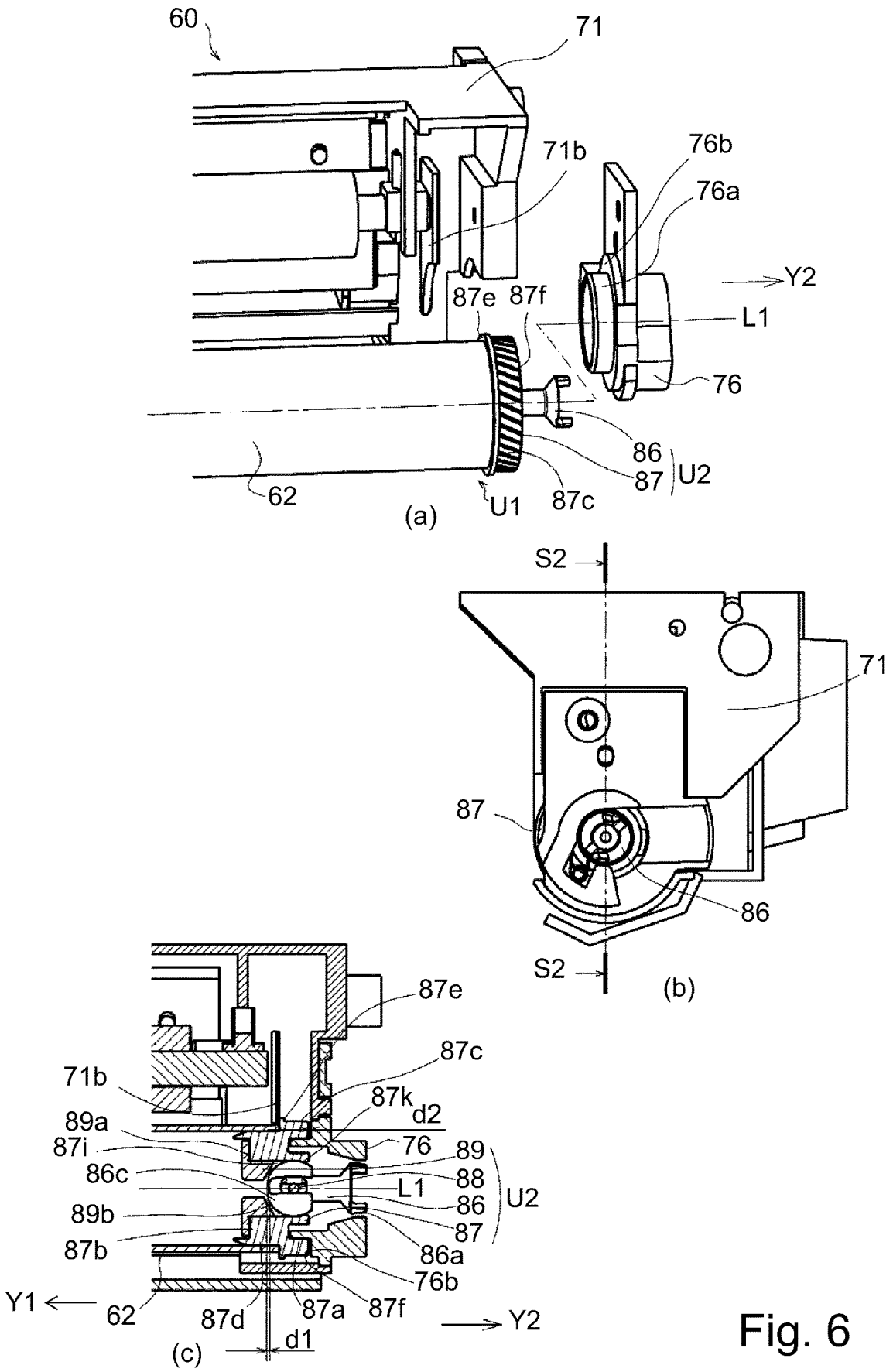

Parts (a), (b) and (c) of FIG. 6 are illustrations of a structure of a cleaning unit 60.

Figure 7:
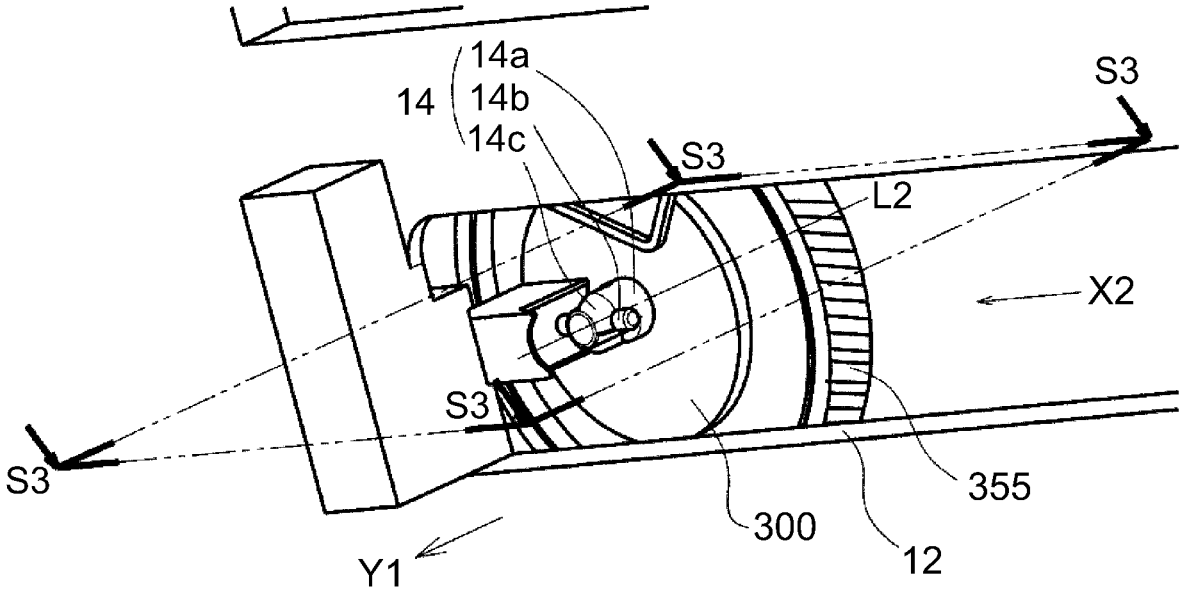
Figure 7:
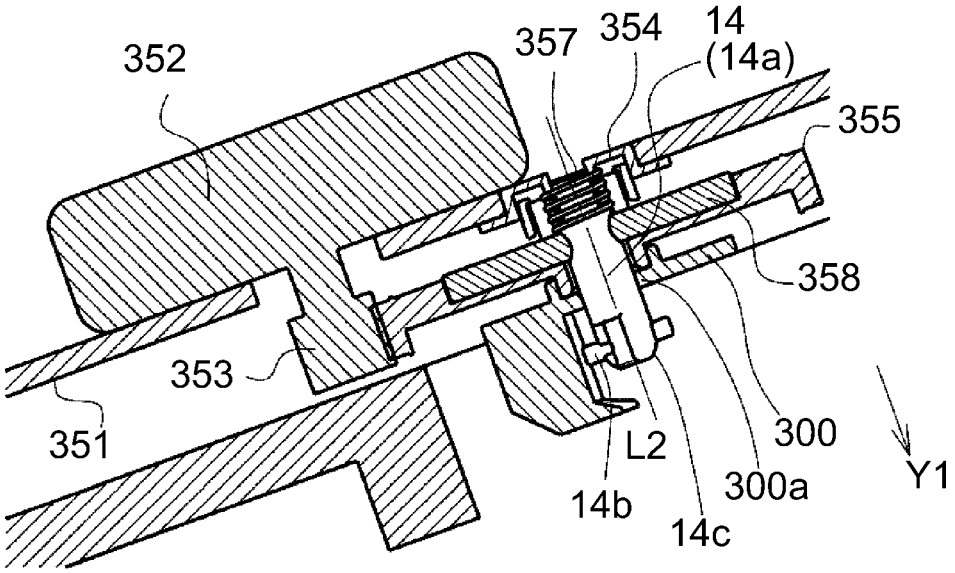

Parts (a) and (b) of FIG. 7 are illustrations of a structure of a coupling driving portion of the apparatus main assembly A.

Figure 8:
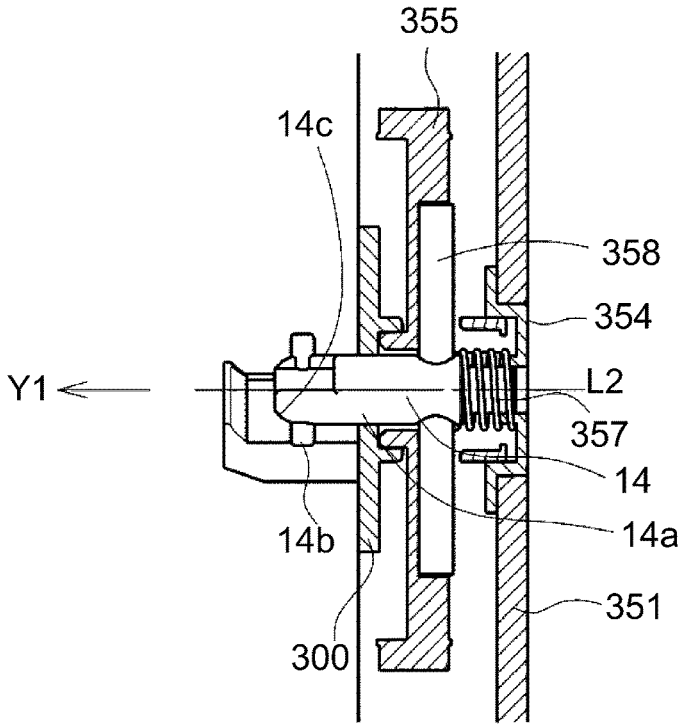
Figure 8:
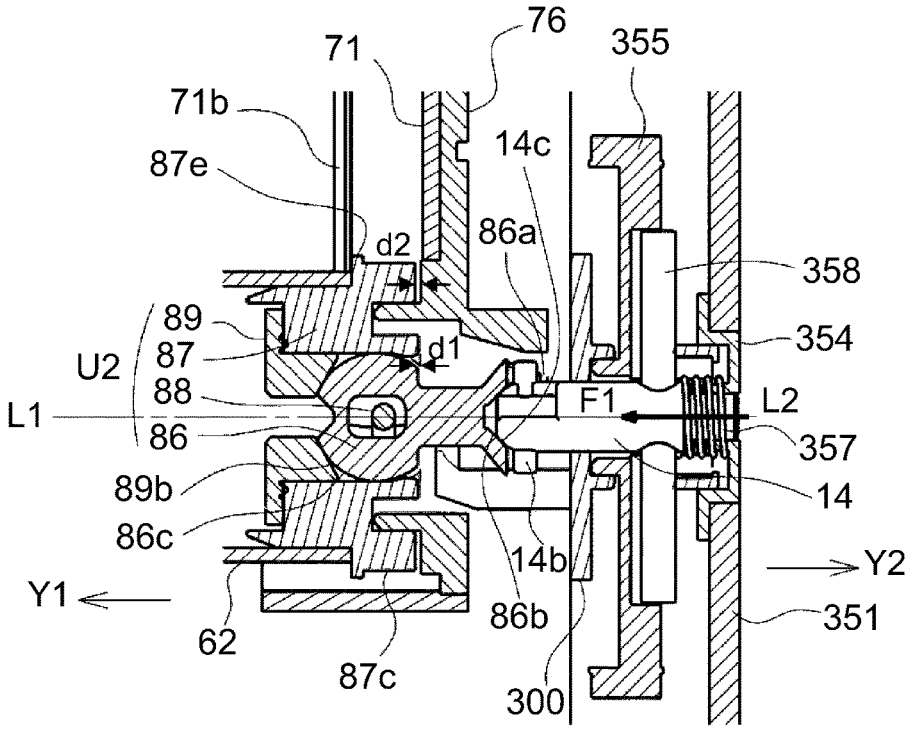

Parts (a) and (b) of FIG. 8 are sectional views for illustrating the apparatus main assembly A and the coupling B.

DESCRIPTION OF EMBODIMENTS

Embodiments for carrying out the present invention will be specifically described with reference to the drawings. Dimensions, materials, shapes and relative arrangements of constituent elements described in the following embodiments should be appropriately be changed depending on structures and various conditions of apparatuses to which the present invention is applied, and the scope of the present invention is not intended to be limited to the following embodiments.

First Embodiment (Image Forming Apparatus)

In the following, as an image forming apparatus using a coupling according to this embodiment of the present invention, a laser beam printer which is an electrophotographic image forming apparatus will be specifically described using the drawings.

Here, the coupling refers to a member which includes at least one of a photosensitive drum and process means and which is mountable in and dismountable from a main assembly of the image forming apparatus (hereinafter, referred to as an apparatus main assembly). As a representative example of the coupling, a process coupling can be cited. This process coupling is prepared by integrally assembling the photosensitive drum and the process means, such as a developing device, actable on the photosensitive drum into a unit (coupling) and is mounted in the apparatus main assembly so as to be dismountable from the apparatus main assembly.

Figure 2:
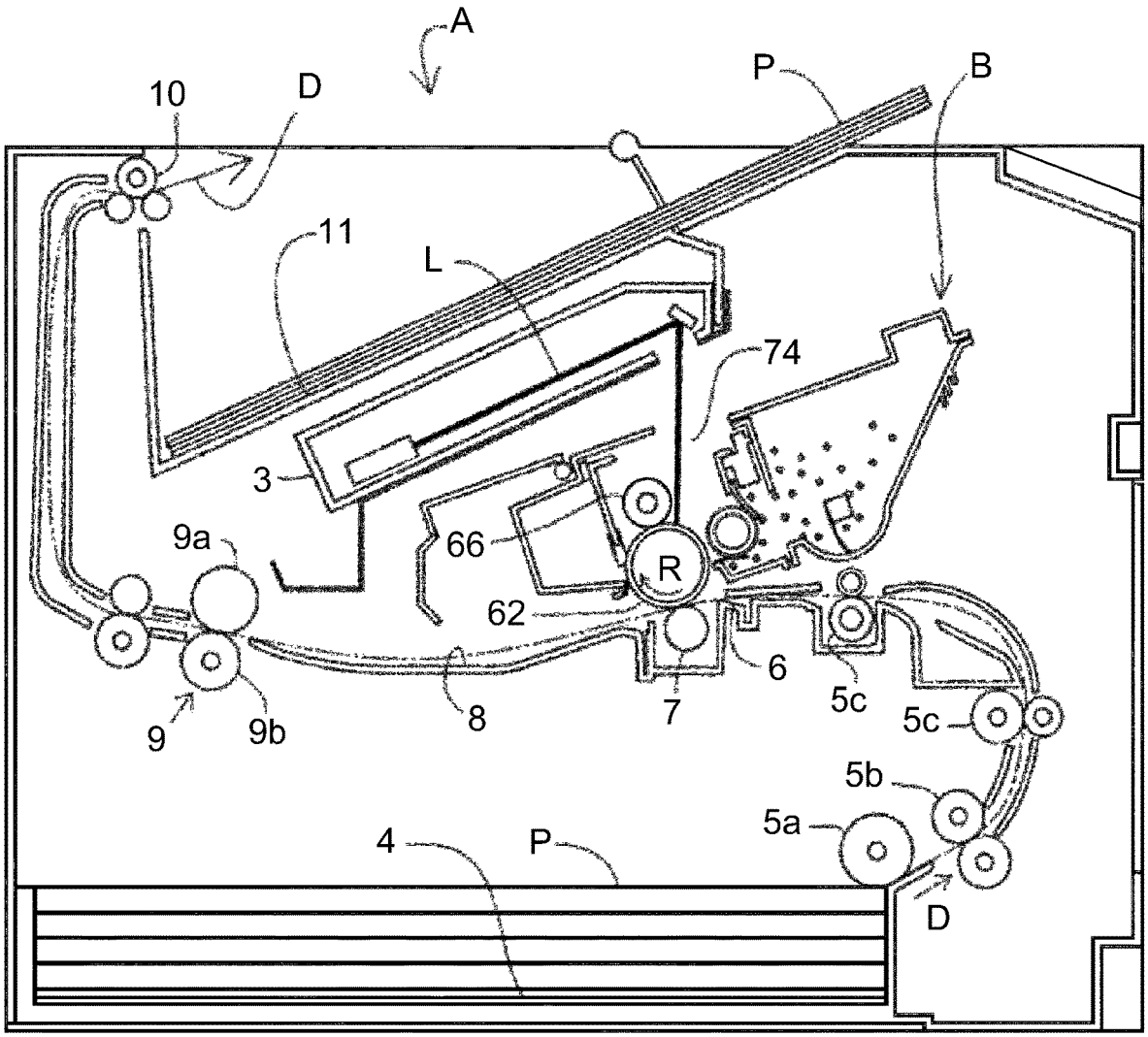
FIG. 2 is a sectional view of an apparatus main assembly A and a coupling B.
Figure 3:
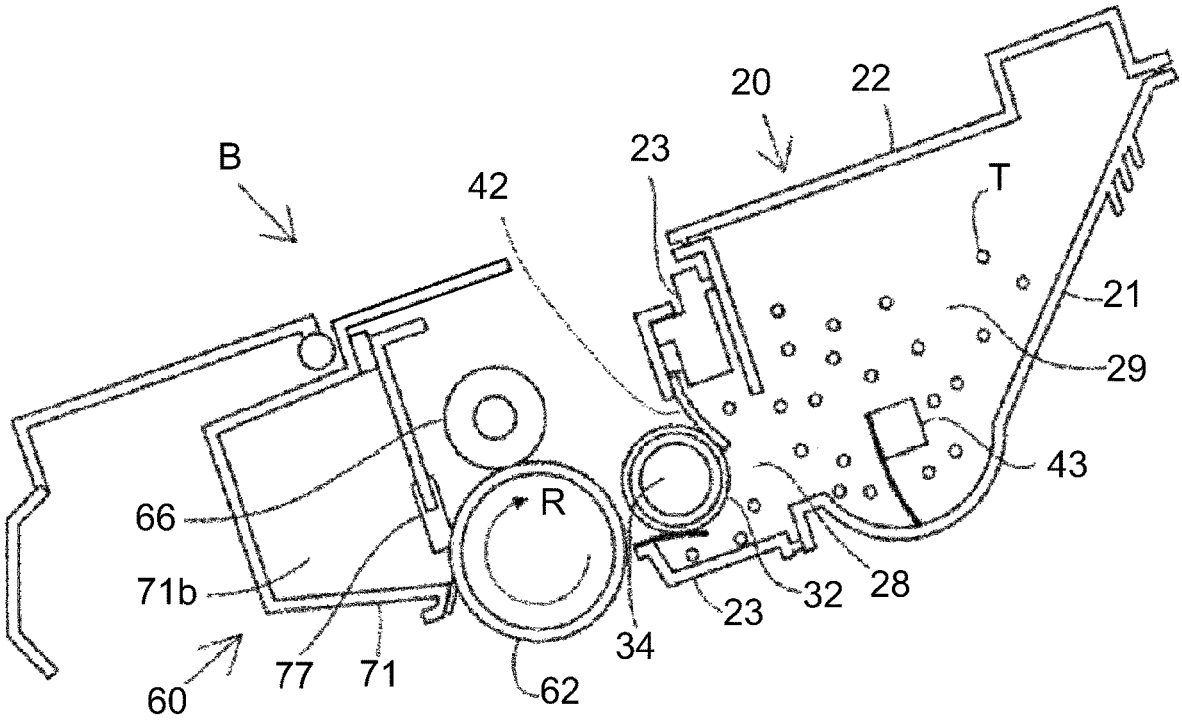
FIG. 3 is a sectional view of the coupling B according to an embodiment of the present invention.

FIG. 2 is a sectional view of an apparatus main assembly A and a coupling (process cartridge) B in this embodiment. FIG. 3 is a sectional view of the coupling B. The apparatus main assembly A is a portion from which the cartridge B of the electrophotographic image forming apparatus is removed. As an example of the electrophotographic image forming apparatus, for example, an electrophotographic copying machine, electrophotographic printers (LED printer, laser beam printer, etc.), a facsimile machine, a word processor, and the like are included.

In the following description, a longitudinal direction of the coupling B is a direction substantially perpendicular to a direction (FIG. 5) in which the coupling B is mounted in and dismounted from the apparatus main assembly A, and is a direction which is parallel to a rotational axis of the photosensitive drum and which crosses a recording material feeding direction. Further, with respect to the longitudinal direction of the coupling B, a side (close to the driving source) where the photosensitive drum receives a rotational force from the apparatus main assembly A is a second direction Y2 side (coupling member 86 side of part (b) of FIG. 4), and a side (spaced from the driving source) opposite from the second direction Y2 side is a first direction Y1 side. That is, the first direction and the second direction are opposite from each other. In FIG. 2, when the cartridge B is mounted in the apparatus main assembly A, on a side below an exposure device (laser scanner unit) 3, the coupling B is provided. Further, below the cartridge B, a sheet tray 4 in which a sheet material P as a recording material (recording medium) to be subjected to image formation is accommodated is provided.

Further, in the apparatus main assembly A, along a feeding direction D of the sheet material P, a pick-up roller 5*a*, a feeding roller pair 5*b*, a conveying roller pairs 5*c* provided at a plurality of positions, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b* so as to form a fixing nip therebetween.

(Image Forming Process)

An outline of an image forming process will be described using FIGS. 2 and 3. On the basis of a print start signal, a photosensitive drum 62 which is a rotatable member is rotationally driven at a predetermined peripheral speed (process speed) in an arrow R direction. Further, a charging roller 66 to which a bias voltage is applied contacts an outer peripheral surface of the drum 62 and electrically charges the outer peripheral surface of the drum 62 uniformly.

The exposure device 3 outputs laser light L depending on image information. The laser light L passes through an exposure window portion 74 provided at an upper surface of the coupling B, so that the outer peripheral surface of the drum 62 is subjected to scanning exposure. As a result, on the outer peripheral surface of the drum 62, an electrostatic latent image depending on the image information is formed. On the other hand, as shown in FIG. 3, in a developing unit 20 (second unit) as a developing device, a developer (hereinafter referred to as toner T) in a toner chamber 29 is stirred and fed by rotation of a feeding member 43, thus being sent to a toner supplying chamber 28.

The toner T is carried by a magnetic force of a magnet roller 34 (fixed magnet) on a surface of a developing roller 32. Then, the toner T is regulated in layer thickness on the peripheral surface of the developing roller 32 by a developing blade 42 while being triboelectrically charged. The toner T is transferred onto the drum 62 depending on the electrostatic latent image, so that the electrostatic latent image is visualized (developed) as a toner image. That is, the drum 62 rotates in the arrow R direction while carrying the toner (toner image).

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11.

On the other hand, as shown in FIG. 3, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

In the above, the charging roller 66, the developing roller 32, and the cleaning blade 77 are process means actable on the drum 62.

(General Structure of Coupling B)

Next, a general structure of the coupling B will be described using FIGS. 3 and 4. Part (a), (b) and (c) of FIG. 4 are illustrations of the coupling B, in which part (a) is a side view of the coupling B as seen from the second direction Y2 side, and parts (b) and (c) are exploded perspective views of the coupling B. As shown in FIG. 4, the coupling B is constituted by combining the cleaning unit 60 and the developing unit 20. The cleaning unit 60 comprises a cleaning (unit) frame 71, the drum 62, the charging roller 66, a bearing member 76 and the cleaning blade 77 and the like.

Here, at an end portion of the drum 62 on the second direction Y2 side which is one end side with respect to a longitudinal direction of the drum 62, a flange unit U2 as a flange including a coupling member 86. The flange unit U2 is fixed to the drum 62, and the flange unit U2 and the drum 62 is integrally rotatable about a rotational axis (axis L1) of the drum 62. Here, a rotational axis direction of the drum 62 is referred to as an axial direction.

On the other hand, the developing unit 20 comprises a toner accommodating container 21, a cap 22, a developing container 23, a developing blade 42, a developing roller 32, a magnet roller 34, a feeding member 43, toner T and the like.

These cleaning unit 60 and developing unit 20 are rotatably connected with each other by a connecting member 75 (part (b) of FIG. 4), so that the coupling B is constituted. Specifically, in part (c) of FIG. 4, at a free end of an arm portion 26*a* of a side member 26 provided at an end portion of the developing unit 20 with respect to the longitudinal direction (the axial direction of the developing roller 32 parallel to the axial direction of the drum 62) of the developing unit 20, a rotation hole 26*b* parallel to the developing roller 32 is provided. Further, at each of longitudinal end portions of the cleaning frame 71, an engaging hole 71*a* for permitting engagement of an engaging member 75 is formed.

Then, the arm portion 26*a* is aligned with a predetermined position of the cleaning frame 71, and the connecting member 75 is inserted into the rotation hole 26*b* and the engaging hole 71*a*, so that the cleaning unit 60 and the developing unit 20 are rotatably connected with each other about the connecting member 75. At this time, an urging member 46 (parts (b) and (c) of FIG. 4) mounted at a base portion of the arm portion 26*a* abuts against the cleaning frame 71, and urges the developing unit 20 toward the cleaning unit 60 about the connecting member 75 as a rotation center. As a result, the developing roller 32 is pressed in the direction of the drum 62 with reliability.

Then, the developing roller 32 is positioned relative to the drum 62 with a predetermined interval by a ring-shaped gap holding member 47 (part (c) of FIG. 4) mounted as a member having a predetermined diameter at each of end portions of the developing roller 32.

Further, at the second direction Y2 side end portion of the developing roller 32, a developing roller gear (developing gear) 33 as a follower gear rotating integrally with the developing roller 32 is provided, so that drive (driving force) is transmitted from a gear portion 87*c* (described specifically later) of a flange 87 to the developing roller gear 33.

(Mounting End Dismounting of Coupling B)

Next, mounting and dismounting of the coupling B relative to the coupling B will be described using FIG. 5. Parts (a) and (b) of FIG. 5 are illustrations showing a state in which the coupling B is being mounted into and dismounted from the apparatus main assembly A, in which part (a) is a perspective view of the apparatus main assembly and the coupling B as seen from the first direction side (the arrow Y1 side of FIG. 4), and part (b) is a perspective view of the apparatus main assembly A and the coupling B as seen from the second direction side (the arrow Y2 side of FIG. 4). The apparatus main assembly A is rotatably provided with an openable door 13. FIG. 5 shows a state in which the openable door 13 is open. Inside the apparatus main assembly A, a main assembly-side engaging portion 14 as a main assembly-side coupling member and a guiding member 12 are provided.

Here, the guiding member 12 is a main assembly-side guiding member for guiding the coupling B into the apparatus main assembly A. Further, the main assembly-side engaging portion 14 is a member for transmitting a rotational force to the coupling member 86 in engagement with the coupling member 86, and is rotatably supported by the apparatus main assembly A. When the coupling B is mounted into the apparatus main assembly A, the coupling B is mounted in an arrow X2 direction along the guiding member 12. Then, when the mounting of the coupling B in the apparatus main assembly A is completed, the coupling member 86 provided in the coupling B engages with the main assembly-side engaging portion 14 and is in a state in which the rotational force is transmittable to the coupling member 86.

(Flange Unit U2)

Next, using FIG. 6, a drum unit U1 and a flange unit U2 will be further specifically described. Here, the drum unit U1 includes, in addition to the drum 62, a grounding plate which contacts an inner peripheral surface of the drum 62 and which is electrically connected to the apparatus main assembly A, and the like.

Parts (a), (b) and (c) of FIG. 6 are illustrations showing a structure of the cleaning unit 60 including the drum unit U1 and the flange unit U2. Part (a) of FIG. 6 is an exploded perspective view of the cleaning unit 60, part (b) of FIG. 6 is a side view of the cleaning unit 60 as seen from the second direction Y2 side, and a sectional view of the cleaning unit 60 of part (b) of FIG. 6 cut along a cutting line S2 of part (b) of FIG. 6. Here, part (c) of FIG. 6 is illustrated so that a gap dl is formed on the first direction Y1 side for convenience of explanation although both gaps dl and d2 are originally formed on the second direction Y2 side as shown in part (b) of FIG. 7.

The gaps d1 and d2 are set as gaps on the basis of a component (part) tolerance of the coupling member 86 and the flange 87, respectively, and are independently of each other. That is, both the gaps may be different values (and it doesn't matter whether or not which is larger) and may also be the same value.

As shown in part (a) and (c) of FIG. 6, at the end portion of the drum unit U1 on the second direction Y1 side, the (flange 87 of) flange unit U2 is fixed. The flange unit U2 is a unit including the flange 87 and includes the coupling member 86, a pin 88 and a limiting member 89 in addition to the flange 87. The drum unit U1 and the flange unit U2 are referred to as a photosensitive member assembly in combination. The photosensitive member assembly includes the photosensitive member 62, the flange 87 and the coupling member 86.

The flange 87 is fixed to the drum 62 at a fixing portion 87*d* (part (c) of FIG. 6) so as to rotate integrally with the drum 62. The drum 62 includes a first end portion and a second end portion which is an end portion opposite from the first end portion with respect to the rotational axis direction of the drum 62. The fixing portion 87*d* is provided at the first end portion. With respect to the drum 62, a first direction is a direction from the first end portion toward the second direction, and a second direction is a direction from the second end portion toward the first end portion.

Further, the flange 87 includes a hollow accommodating portion 87*i* (part (c) of FIG. 6), a gear portion 87*c* (part (a) of FIG. 6) as a helical gear for transmitting drive (driving force) to the developing roller gear 33, an annular (ring) rib 87*e* (part (c) of FIG. 6) as a portion-to-be-limited, and the like.

As shown in part (c) of FIG. 6, the coupling member 86 principally includes a rotational force receiving portion (engaging portion) 86*a* and a connecting portion 87*i* of the flange 87 and is prevented by a conical portion (coupling limiting portion) 87*k* from being disconnected (disengaged) from the accommodating portion 87*i* toward an outside (the second direction Y2 side) of the flange 87. On the other hand, the rotational force receiving portion 86*a* projects toward the outside (the second direction Y2 side) of the flange 87 so that the rotational force receiving portion 86*a* can engage with the main assembly-side engaging portion 14 (as specifically described later).

Further, as shown in part (c) of FIG. 6, the limiting member (coupling limiting portion) 89 is fixed to a portion-to-be-fixed 87*b* of the flange 87. Then, the limiting portion 89*b* of the limiting member 89 limits movement of the connecting portion 86*c* (part (c) of FIG. 6) toward the first direction Y1 side so that the coupling member 86 is not disengaged toward the first direction side of the flange 87.

The conical portion 87*k* and the limiting member 89 constitutes the conical portion limiting portion for limiting a position of the coupling member 86 with respect to the rotational axis direction of the drum 62.

Further, the pin 88 (part (c) of FIG. 6, part (b) of FIG. 8) accommodated in the accommodating portion 87*i* of the flange 87 penetrates a hole of the coupling member 86, so that the coupling member 86 and the flange 87 are rotated integrally with each other.

The flange unit U2 constituted as described above is configured so that when the rotational force of the main assembly-side engaging portion 14 is transmitted to the coupling member 86, the rotational force is transmitted to the flange 87 via the pin 88. Then, the rotational force can be transmitted from the flange 87 to the drum 62 and the developing roller gear 33.

Here, the connecting portion 86*c* of the coupling member 86 has a gap with either one of a limiting surface 89*b* of the limiting member 89 or the conical portion 87*k* of the flange 87. For convenience of explanation, in part (c) of FIG. 6, a state in which the connecting portion 86*c* of the coupling member 86 and the conical portion 87*k* of the flange 87 are in contact with each other and thus the gap dl is formed between the connecting portion 86*c* and the limiting surface 89*b* is shown. The reason why such a gap is provided is that in consideration of the component tolerance, the coupling member 86 is accommodated in the flange unit U2. Accordingly, the coupling member 86 is movable by a certain amount (which is equal to the gap dl) in an axial direction L1 relative to the flange unit U2.

Here, a position (position where the connecting portion 86*c* contacts the conical portion 87*k*) where the coupling member 86 most shifts to the second direction Y2 side in the flange unit U2 is referred to as a third position. Further, a position (position where the connecting portion 86*c* contacts the limiting portion 89*b*) where the coupling member 86 most shifts to the first direction Y1 side in the flange unit U2 is referred to as a fourth position. The movement of the coupling member 86 in the second direction is limited to the third position by the conical portion 87*k*. The movement of the coupling member 86 in the first direction is limited to the fourth position by the limiting member 89.

Then, using FIG. 6, positioning of the drum unit U1 in the cleaning unit 60 will be specifically described. As shown in part (a) of FIG. 6, the bearing member 76 includes a cylindrical supporting portion 76*a* with an axis L1 as a center and a limiting surface 76*b* perpendicular to the axis L1. The supporting portion 76*a* engages with a portion-to-be-supported 87*a* of the flange 87 and rotatably supports the flange 87. This bearing member 76 is fixed to the cleaning frame 71, so that the drum unit U1 is rotatably supported in the cleaning unit 60. That is, the drum 62 or the drum unit U1 can be said to be supported by the flange 71 so as to be displaceable in the axial direction.

Further, the cleaning flange 71 is provided with a rib 71*b* as a limiting portion (photosensitive member limiting portion). When the drum unit U1 is supported by the cleaning unit 60, the rib 71*b* opposes the annular rib 87*e* of the flange 87 and limits movement of the drum unit U1 toward the first direction Y1 side. On the other hand, the limiting surface (photosensitive member limiting portion) 76*b* of the bearing member 76 opposes an end surface 87*f* of the flange 87 and limits movement of the drum unit U1 toward the second direction Y2 side. The rib 71*b* limits the movement of the drum unit U 1 in the first direction to a second position, and the limiting surface 76*b* of the bearing member 76 limits the movement of the drum unit U1 in the second direction to a first position.

Here, the flange 87 has a gap at least one of between the annular rib 87*e* and the rib 71*b* of the cleaning flange 71 and between the end surface 87*f* and the limiting surface 76*b* of the bearing member 76. In part (c) of FIG. 6, a state in which the annular rib 87*e* and the rib 71*b* of the cleaning flange 71 are in contact with each other and thus the gap d2 is formed between the end surface 87*f* and the limiting surface 76*b* is shown. The reason why such a gap is provided is that the flange 87 is accommodated in the cleaning unit 60 in consideration of the component tolerance.

Accordingly, the flange 87 (and the flange unit U2 and the drum unit U1) are disposed movably by a certain amount (which is equal to the gap d2) in the axial direction L1 in the cleaning unit 60. Here, a position (position where the end surface 87*f* contacts the limiting surface 76*b*) where the drum unit U1 most shifts toward the second direction Y2 side in the cleaning unit 60 is referred to as the first position. On the other hand, a position (position where the annular rib 87*e* contacts the rib 71*b*) where the drum unit U1 most shifts toward the first direction Y1 side in the cleaning unit 60 is referred to as the second position.

(Driving Portion of Apparatus Main Assembly A)

A structure of a coupling driving portion of the apparatus main assembly A will be described using FIG. 7. Part (a) of FIG. 7 is a partially enlarged view of the driving portion, and part (b) of FIG. 7 is a sectional view of the driving portion cut along a flat surface S3 (flat surface including a rotational axis L2 of the main assembly-side engaging portion 14) shown in part (a) of FIG. 7.

As shown in part (b) of FIG. 7, the coupling driving portion of the apparatus main assembly A is constituted by the main assembly-side engaging portion 14, a side plate 351, a holder 300, a driving gear 355, a driving pin 358, an urging spring 357 as an urging member, and the like. Further, in part (a) of FIG. 7, on a free end side of the main assembly-side engaging portion 14 with respect to the first direction Yl, an annular shaft portion 14*a* with the rotational axis L2 as a center and a spherical portion 14*c* for performing positioning in contact with the coupling member 86 are provided. Further, a rotational force imparting portion 14*b* for transmitting a rotational force to the coupling member 86 is provided.

Here, as shown in part (b) of FIG. 7, the driving pin 358 is fixed integrally with the shaft portion 14*a* of the main assembly-side engaging portion 14, so that the main assembly-side engaging portion 14 and the driving gear 355 can be integrally rotated via the driving pin 358. Further, the shaft portion 14*a* is rotatably supported by supporting portions 300*a* of the holder 300 and bearings 354 at different positions with respect to the axial direction.

In part (b) of FIG. 7, the bearing 354 and a motor 352 are mounted on the side plate 351, and a pinion gear 353 is provided on a rotation shaft of the motor 352. The pinion gear 353 engages with the driving gear 355, and therefore, when the motor 352 rotates, the driving gear 355 is rotated and the main assembly-side engaging portion 14 is also rotated. Further, between the bearing 354 and the driving pin 358, the urging spring 357 as the urging member is provided, and urges the driving pin 358 and the main assembly-side engaging portion 14 toward the first direction Y1 side.

(Engagement of Coupling Member 86 and Main Assembly-Side Engaging Portion 14)

Next, a state in which the coupling B is mounted in the apparatus main assembly A and the coupling member 86 and the main assembly-side engaging portion 14 are engaged with each other will be described using FIG. 8. Parts (a) and (b) of FIG. 8 are sectional views of the apparatus main assembly A and the coupling B, in which part (a) shows a state in which the coupling B is not mounted in the apparatus main assembly A, and part (b) shows a state in which the coupling B is mounted in the apparatus main assembly A.

When the coupling B is mounted in the apparatus main assembly A, the cleaning unit 60 in the coupling B is positioned relative to the apparatus main assembly A with respect to the axis L1 direction by an unshown positioning mechanism. Then, the position of the coupling member 86 relative to the apparatus main assembly A is determined through the cleaning frame 71, the flange 87 and the limiting member 89. Then, the main assembly-side engaging portion 14 contacts the (conical portion 86*b*) of the coupling member 86 at the spherical portion 14*c* thereof, and moves toward the second direction Y2 side compared with a state of part (a) of FIG. 8 in which the coupling B is not mounted in the apparatus main assembly A.

Then, an urging force F1 of the urging spring 357 acts from the main assembly-side engaging portion 14 on the coupling member 86, so that the coupling member 86 is moved to the fourth position in the flange unit U2. That is, the connecting portion of the coupling member 86 and the limiting surface 89*b* of the limiting member 89 contact each other. Then, the flange unit U2 is moved to the second position in the cleaning unit 60 by the urging force F1. That is, the annular rib 87*e* of the flange 87 contacts the rib 71*b* of the cleaning frame 71. As a result, the rib 71*b* of the cleaning frame 71 contacts the annular rib 87*e* with a contact force which is the same as the urging force F1.

As described above, according to this embodiment, the coupling member 86 and the main assembly-side engaging portion 14 are in a state in which the annular portion 86*b* and the spherical portion 14*c* are always in contact with each other under application of the urging force F1. That is, at the time when the mounting of the coupling B in the apparatus main assembly A is completed, the annular portion 86*b* of the coupling member 86 maintains a state of contacting the spherical portion.

Then, as in the above-described prior art, compared with the case where even in a state in which the coupling B is mounted in the apparatus main assembly A, the position of the coupling member 86 is not determined in the flange unit U2 and in the cleaning unit 60, a mutual positional relationship is determined with high accuracy.

Figure 1:
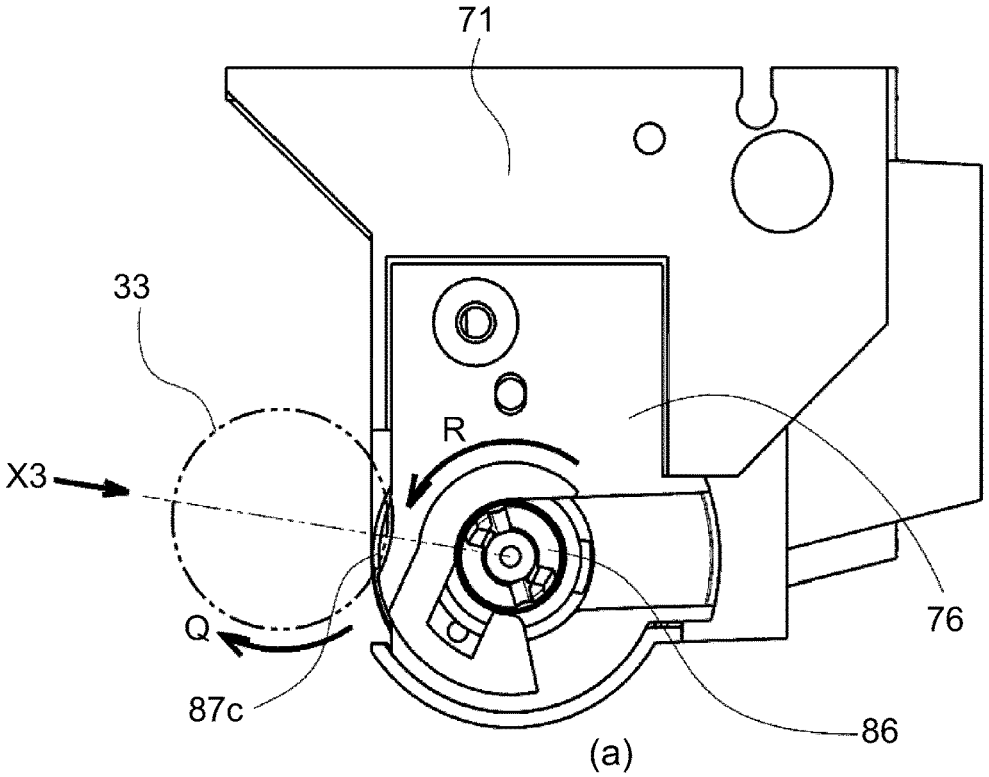
Figure 1:
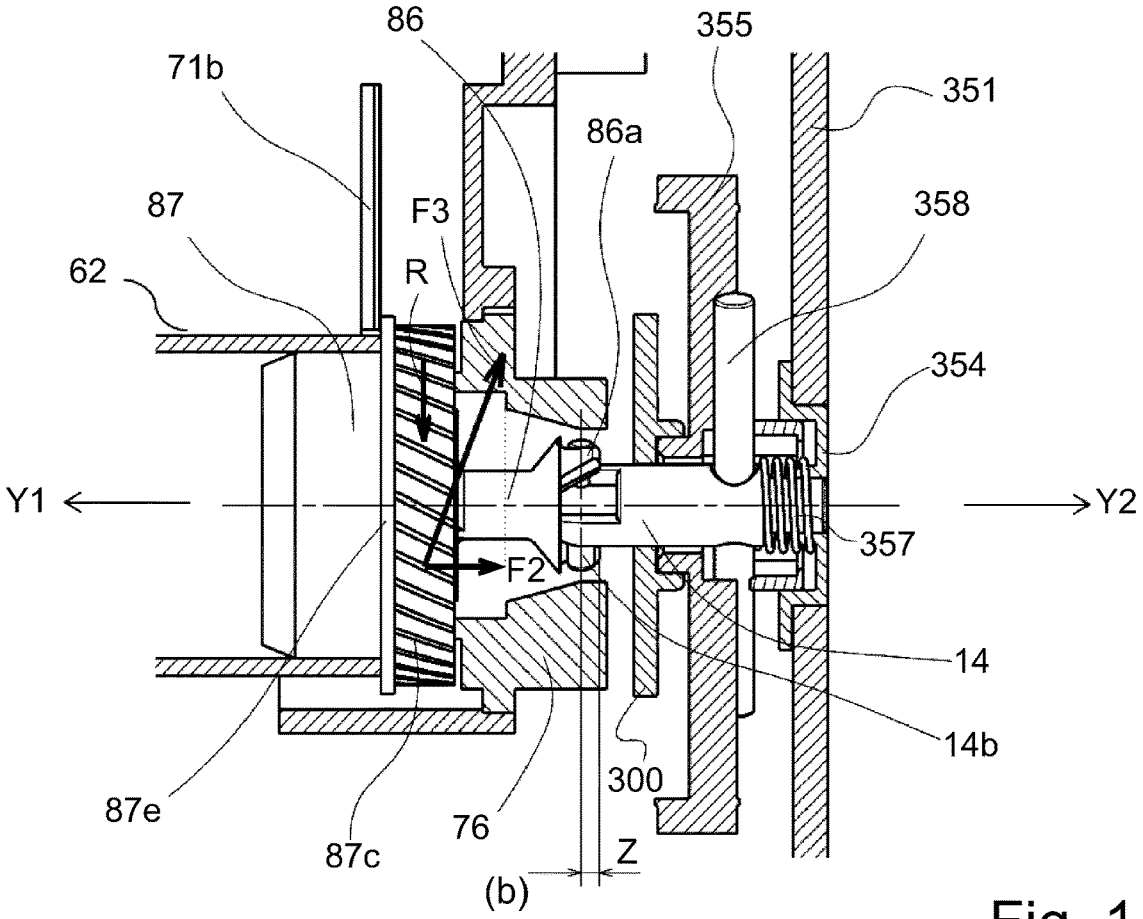

Accordingly, even when an engagement amount Z (part (b) of FIG. 1) between the rotational force receiving portion 86*a* of the coupling member 86 and the rotational force imparting portion 14*b* of the main assembly-side engaging portion 86 is made small, the main assembly-side engaging portion 14 and the coupling member 86 can perform drive transmission therebetween with reliability.

As a result, with respect to the axis L1 direction, the rotational force receiving portion 86*a* of the coupling member 86 can be made small, so that the coupling member 86 can be downsized with respect to the axis L1 direction. Further, the engagement amount Z (part (b) of FIG. 1) between the rotational force receiving portion 86*a* of the coupling member 86 and the rotational force imparting portion 14*b* of the main assembly-side engaging portion 14 can be made small, so that the rotational force receiving portion 86*a* and the rotational force imparting portion 14*b* can be downsized with respect to the axis L1 direction.

(Component Forces during Transmission of Rotational Force)

Next, a state when the rotational force is transmitted from the main assembly-side engaging portion 14 to the coupling member 86 will be described using FIG. 1. Parts (a) and (b) of FIG. 1 are illustrations of the cleaning unit 60 when the rotational force is transmitted to the coupling member 86. Part (a) of FIG. 1 is a side view of the cleaning unit 60 as seen in the second direction and schematically illustrates the developing roller gear 33. Part (b) of FIG. 1 is a schematic view of the cleaning unit 60 of part (a) of FIG. 1 as seen from the developing roller gear 33 side (as seen in an arrow X3 direction) and illustrates the cleaning unit 60 by illustrating also the driving portion of the apparatus main assembly A. Further, part (b) of FIG. 1 is also a partially sectional view showing a part of components in cross section for explanation.

As shown in part (b) of FIG. 1, when the main assembly-side engaging portion 14 is rotated, the rotational force receiving portion 86*a* of the coupling member 86 and the rotational force imparting portion 14*b* engage with each other, so that the rotational force is transmitted to the coupling member 86. Then, as described above, the flange 87 and the drum 62 are rotated. Further, the gear portion 87*c* of the flange 87 transmits the rotational force to the developing roller gear 33, so that the developing roller gear 33 (and the developing roller 32) are rotated in an arrow Q direction (part (a) of FIG. 1).

At this time, a reaction force F3 for rotationally driving the developing roller gear 33 generates at the gear portion 87*c*. Then, of this reaction force F3, a component force F2 as a component with respect to the second direction Y2 acts so as to reduce a contact force between the rib 71*b* of the cleaning frame 71 and the annular rib 87*e* of the flange 87. Then, a degree of abrasion by sliding between the rib 71*b* and the annular rib 87*e* is reduced, and therefore, the flange 87 and the drum 62 can rotate integrally with each other with high accuracy though a durable state of the coupling B. As a result, a good image can be always provided to a user.

That is, a tooth trace of the gear portion 87*c* extends in a twisting direction in which the gear portion 87*c* receives, from the developing roller gear 33, the force F2 for moving the flange 87 in the second direction by engagement thereof with the developing roller gear 33.

As described above, according to this embodiment, in a coupling constitution including the drum unit U1 and the coupling member 86 having an axial direction in which a position of the coupling member 86 is not uniquely determined relative to the drum unit U1, a relative position between the coupling member 86 and the main assembly-side engaging portion 14 can be determined with high accuracy. As a result, the coupling member 86 can be downsized. Further, the engagement amount (part (b) of FIG. 1) between the coupling member 86 and the main assembly-side engaging portion 14 can be made small, and therefore, the rotational force receiving portion 86*a* and the rotational force imparting portion 14*b* can be downsized with respect to the axis L1 direction.

Further, a force exerted on the positioning portions (the rib 71*b* and the annular rib 87*e*) which slide with each other is reduced, so that durability of the positioning portions can be improved. As a result, the good image can be provided to the user through use of the coupling B.

(Modified Embodiments)

The preferred embodiment of the present invention was described above, but the present invention is not limited thereto. Various modifications and changes of constitutions of the direction are possible within the scope of the present invention.

Modified Embodiment 1

In the above-described embodiment, an example in which the rotational axis L1 of the drum 62 and the rotational axis L2 of the main assembly-side engaging portion 14 are on the same line together with a center line of the coupling member was described, but the present invention is not limited thereto. The present invention is also applicable to a constitution (part (b) of FIG. 7 of JP-A 2015-79243) in which the coupling member is constituted so as to be tiltable relative to the rotational axis of the photosensitive drum and in which the rotational axis of the photosensitive drum and the rotational axis of the main assembly-side engaging portion are parallel to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-028912 filed on Feb. 21, 2018, which is hereby incorporated by reference herein in its entirety.

What is claimed is:

1. A cartridge mountable in and dismountable from a main assembly of an image forming apparatus, said cartridge comprising:

a photosensitive member assembly including, a photosensitive member including a first end portion and a second end portion opposite from the first end portion with respect to a rotational axis direction thereof, a flange fixed at the first end portion of said photosensitive member so as to rotate together with said photosensitive member, and a coupling member configured to receive, from the main assembly, a driving force for rotating said photosensitive member, said coupling member including a connecting portion configured to connect with said flange and an engaging portion configured to engage with a main assembly driving portion of the main assembly;

a photosensitive member limiting portion configured to limit movement of said photosensitive member assembly in the rotational axis direction including a first direction from the first end portion toward the second end portion and a second direction from the second end portion toward the first end portion, wherein said photosensitive member limiting portion limits the movement of said photosensitive member assembly to a first position in the second direction and limits the movement of said photosensitive member assembly to a second position in the first direction; and a coupling member limiting portion configured to limit movement of said coupling member in the rotational axis direction to a third position in the second direction and to a fourth position in the first direction, wherein said cartridge is constituted so that said photosensitive member assembly is in the second position and said coupling member is in the fourth position when said cartridge is mounted in the main assembly and said engaging portion of said coupling member engages with the main assembly driving portion and said coupling member is urged in the first direction by the main assembly driving portion.

2. A cartridge according to claim 1, further comprising.

a developing roller configured to supply toner to said photosensitive member, and a developing gear fixed to an end portion of said developing roller with respect to a rotational axis direction of said developing roller so as to rotate together with said developing roller, wherein said flange includes a helical gear portion configured to engage with said developing gear, and wherein said helical portion has a tooth trace extending in a twisting direction in which said helical gear portion receives, from said developing gear, a force for moving said flange in the second direction by engagement thereof with said developing gear.

3. A cartridge according to claim 1, further comprising a frame configured to rotatably support said photosensitive member assembly, wherein said photosensitive member limiting portion which limits the movement of said photosensitive member assembly to the second position in the first direction is a part of said frame.

4. A cartridge according to claim 1, further comprising a bearing configured to rotatably support said photosensitive member assembly, wherein said photosensitive member limiting portion which limits the movement of said photosensitive member assembly to the first position in the second direction is a part of said bearing.

5. A cartridge according to claim 1, wherein said coupling member limiting portion is provided on said frame.

6. An image forming apparatus comprising:

a main assembly including a driving source, a main assembly driving portion configured to be rotationally driven by said driving source, and an urging member configured to urge said main assembly driving portion; and a cartridge including a photosensitive member assembly which includes a photosensitive member and configured to be mountable in and dismountable from said main assembly, wherein said photosensitive member includes a first end portion and a second end portion opposite from the first end portion with respect to a rotational axis direction of said photosensitive member assembly, wherein said photosensitive member assembly includes a flange fixed at the first end portion of said photosensitive member so as to rotate together with said photosensitive member, and includes a coupling member configured to receive, a driving force for rotating said photosensitive member assembly, said coupling member including a connecting portion configured to connect with said flange and an engaging portion configured to engage with said main assembly driving portion, wherein said cartridge includes a photosensitive member limiting portion configured to limit movement of said photosensitive member assembly in the rotational axis direction including a first direction from the first end portion toward the second end portion and a second direction from the second end portion toward the first end portion, wherein said photosensitive member limiting portion limits the movement of said photosensitive member assembly to the first position in the second direction and limits the movement of said photosensitive member assembly a the second position in the first direction, and wherein said cartridge includes a coupling member limiting portion configured to limit movement of said coupling member in the rotational axis direction to a third position in the second direction and to a fourth position in the first direction, and wherein said main assembly driving portion urges said coupling member by an urging force of said urging member so that said photosensitive member assembly is in the second position and said coupling member is in the fourth position when said cartridge is mounted in the main assembly and said engaging portion of said coupling member engages with said main assembly driving portion.

7. An image forming apparatus according to claim 6, wherein said cartridge includes, a developing roller configured to supply toner to said photosensitive member, a developing gear fixed to an end portion of said developing roller with respect to a rotational axis direction of said developing roller so as to rotate together with said developing roller, and wherein said flange includes a helical gear portion configured to engage with said developing gear, and wherein said helical portion has a tooth trace extending in a twisting direction in which said helical gear portion receives, from said developing gear, a force for moving said flange in the second direction by engagement thereof with said developing gear.

8. An image forming apparatus according to claim 6, wherein said cartridge includes a frame configured to rotatably support said photosensitive member assembly, and wherein said photosensitive member limiting portion which limits the movement of said photosensitive member assembly to the second position in the first direction is a part of said frame.

9. An image forming apparatus according to claim 6, wherein said cartridge includes a bearing configured to rotatably support said photosensitive member assembly, and wherein said photosensitive member limiting portion which limits the movement of said photosensitive member assembly to the first position in the second direction is a part of said bearing.

10. An image forming apparatus according to claim 6, wherein said coupling member limiting portion is provided on said frame.

* * * * *